US010825600B2

(12) United States Patent
Cha et al.

(10) Patent No.: US 10,825,600 B2
(45) Date of Patent: Nov. 3, 2020

(54) COIL COMPONENT AND METHOD OF MANUFACTURING THE SAME

(71) Applicant: SAMSUNG ELECTRO-MECHANICS CO., LTD., Suwon-si, Gyeonggi-do (KR)

(72) Inventors: Il Ho Cha, Suwon-si (KR); Sang Jae Lee, Suwon-si (KR); Jae Ha Kim, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 238 days.

(21) Appl. No.: 15/834,745

(22) Filed: Dec. 7, 2017

(65) Prior Publication Data

US 2019/0019616 A1 Jan. 17, 2019

(30) Foreign Application Priority Data

Jul. 17, 2017 (KR) ..... 10-2017-0090235

(51) Int. Cl.
*H01F 27/28* (2006.01)
*H01F 27/32* (2006.01)
(Continued)

(52) U.S. Cl.
CPC ..... *H01F 27/2804* (2013.01); *H01F 17/0006* (2013.01); *H01F 17/04* (2013.01);
(Continued)

(58) Field of Classification Search
USPC ..... 336/192, 200, 232
See application file for complete search history.

(56) References Cited

U.S. PATENT DOCUMENTS

2005/0195062 A1 9/2005 Yoshida et al.
2015/0048918 A1* 2/2015 Park ..... H01F 17/0013 336/200

(Continued)

FOREIGN PATENT DOCUMENTS

JP 2005-243806 A 9/2005
JP 2015-037189 A 2/2015

(Continued)

OTHER PUBLICATIONS

Japanese Office Action dated Aug. 14, 2018 issued in Japanese Patent Application No. 2017-238914 (with English translation).

*Primary Examiner* — Elvin G Enad
*Assistant Examiner* — Kazi S Hossain
(74) *Attorney, Agent, or Firm* — Morgan, Lewis & Bockius LLP

(57) ABSTRACT

A coil component includes: a first coil layer; and a second coil layer disposed on the first coil layer, wherein the first coil layer includes a first insulating layer and a first coil conductor embedded in the first insulating layer, the second coil layer includes a second insulating layer and a second coil conductor embedded in the second insulating layer, the first and second coil conductors are electrically connected to each other by a through-conductor formed in the first insulating layer, and cavities vertically penetrating through the first and second coil layers are provided in core regions of the first and second coil layers, respectively.

12 Claims, 7 Drawing Sheets

I-I'

(51) Int. Cl.

| | |
|---|---|
| ***H01F 41/12*** | (2006.01) |
| ***H01F 27/29*** | (2006.01) |
| ***H01F 41/04*** | (2006.01) |
| ***H01F 27/24*** | (2006.01) |
| ***H01F 17/04*** | (2006.01) |
| ***H01F 17/00*** | (2006.01) |

(52) U.S. Cl.
CPC ..... *H01F 27/24* (2013.01); *H01F 27/292* (2013.01); *H01F 27/324* (2013.01); *H01F 41/041* (2013.01); *H01F 41/125* (2013.01)

(56) References Cited

U.S. PATENT DOCUMENTS

| | | | | |
|---|---|---|---|---|
| 2015/0155093 | A1* | 6/2015 | Kim | H01F 17/0013 336/192 |
| 2016/0217906 | A1* | 7/2016 | Park | H01F 17/0013 |
| 2016/0247623 | A1* | 8/2016 | Marusawa | H01F 27/255 |
| 2016/0276094 | A1 | 9/2016 | Lee et al. | |
| 2017/0098997 | A1 | 4/2017 | Hamada et al. | |
| 2017/0133145 | A1 | 5/2017 | Hong et al. | |

FOREIGN PATENT DOCUMENTS

| | | | |
|---|---|---|---|
| JP | 2017-069523 | A | 4/2017 |
| JP | 2017-092444 | A | 5/2017 |
| KR | 10-2014-0024151 | A | 2/2014 |
| KR | 10-2015-0019588 | A | 2/2015 |

* cited by examiner

COIL COMPONENT AND METHOD OF MANUFACTURING THE SAME

CROSS-REFERENCE TO RELATED APPLICATION(S)

This application claims the benefit of priority to Korean Patent Application No. 10-2017-0090235 filed on Jul. 17, 2017 in the Korean Intellectual Property Office, the disclosure of which is incorporated herein by reference in its entirety.

TECHNICAL FIELD

The present disclosure relates to a coil component and a method of manufacturing the same.

BACKGROUND

A direct current (DC) to DC converter of a mobile device converts a voltage into a voltage required in an internal circuit through a power management integrated circuit (PMIC) integrated as in a single chip and uses the converted voltage. In this case, a capacitor and an inductor, i.e., passive elements, are required.

Recently, as power consumption has increased, in accordance with diversification of functions of mobile devices, passive elements having low loss and excellent efficiency are used in the surroundings of the PMIC in order to increase the duration of time for which a battery of the mobile device is used. Among these passive elements, a power inductor capable of reducing a size of a product and a capacity of the battery due to excellent efficiency and having a small size and a low profile has been preferred.

Particularly, as wearable products have recently appeared, it has been expected that competition for the miniaturization of wearable products will be accelerated, and power inductors used in such wearable products have also been required to have a small size and high efficiency.

Recently, as a small power inductor, a thin film type power inductor in which a thin film type coil is formed on a substrate by plating, a cavity is formed in a central portion of the substrate by laser processing, the surroundings of the thin film type coil including the cavity, filled with a magnetic material, has been mainly used. However, in such a thin film type power inductor, a large amount of foreign materials may be generated in a process of forming the cavity, and a notch having a V shape may be formed in a sidewall of the cavity, such that cracking may frequently occur in a magnetic body.

SUMMARY

An aspect of the present disclosure may provide a coil component in which a crack of a magnetic body may be effectively prevented, and a method of manufacturing the same.

According to an aspect of the present disclosure, a coil component may include a first coil layer, and a second coil layer disposed on the first coil layer. The first coil layer includes a first insulating layer and a first coil conductor embedded in the first insulating layer, the second coil layer includes a second insulating layer and a second coil conductor embedded in the second insulating layer. The first and second coil conductors are electrically connected to each other by a through-conductor formed in the first insulating layer, and cavities vertically penetrating through the first and second coil layers are provided in core regions of the first and second coil layers, respectively.

According to another aspect of the present disclosure, a method of manufacturing a coil component may include preparing a substrate having a metal layer disposed on at least one surface thereof and forming a first basic plating layer on the metal layer of the substrate, forming a first structure in each of a core region and an outer side region of the first basic plating layer, forming a first anisotropic plating layer on the first basic plating layer to obtain a first coil conductor having a height lower than that of the first structure, filling an insulating material in a region surrounding the first coil conductor to form a first insulating layer having the same height as that of the first structure, removing portions of the first insulating layer to expose an upper surface of an innermost distal end of the first coil conductor and forming a seed layer on an upper surface of the first insulating layer, forming a through-conductor and a second basic plating layer on the seed layer, forming a second structure on the first structure, forming a second anisotropic plating layer on the second basic plating layer to obtain a second coil conductor having a height lower than that of the second structure, filling an insulating material in a region surrounding the second coil conductor to form a second insulating layer having the same height as that of the second structure, separating the substrate on which the metal layer is disposed, and removing the first and second structures by chemical etching.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
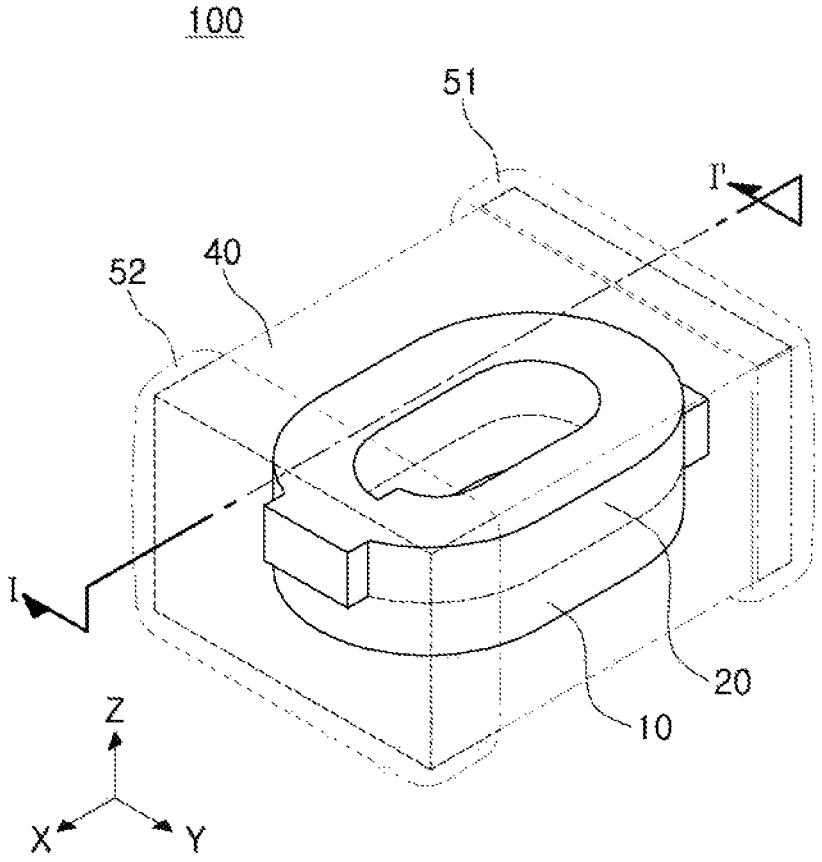
FIG. 1 is a schematic perspective view illustrating a coil component according to an embodiment in the present disclosure so that first and second coil layers of the coil component are viewed.

Hereinafter, embodiments of the present disclosure will now be described in detail with reference to the accompanying drawings. In the accompanying drawings, shapes, sizes and the like, of the components may be exaggerated or shortened for clarity.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being 'on,' 'connected to,' or 'coupled to' another element, it can be directly 'on,' 'connected to,' or 'coupled to' the other element or other elements intervening therebetween may be present. In contrast, when an element is referred to as being 'directly on,' 'directly connected to,' or 'directly coupled to' another element, there may be no other elements or layers intervening therebetween. Like numerals refer to like elements throughout. As used herein, the term 'and/or' includes any and all combinations of one or more of the associated listed items.

It will be apparent that although the terms first, second, third, etc. may be used herein to describe various members, components, regions, layers and/or sections, any such members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the embodiments.

Spatially relative terms, such as 'above,' 'upper,' 'below,' and 'lower' and the like, may be used herein for ease of description to describe one element's relationship relative to another element(s) as shown in the figures. It will be understood that spatially relative terms are intended to encompass different orientations of the device in use or operation, in addition to the orientation depicted in the figures. For example, if the device in the figures is turned over, elements described as 'above,' or 'upper' relative to other elements would then be oriented 'below,' or 'lower' relative to the other elements or features. Thus, the term 'above' can encompass both the above and below orientations depending on a particular direction of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms 'a,' 'an,' and 'the' are intended to include the plural forms as well, unless the context clearly indicates otherwise. It will be further understood that the terms 'comprises,' and/or 'comprising' when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted alone, in combination or in partial combination.

The contents of the present disclosure described below may have a variety of configurations and propose only a required configuration herein, but are not limited thereto.

Hereinafter, a coil component according to an embodiment in the present disclosure will be described, and a power inductor will be described as an example of the coil component for convenience. However, the present disclosure is not necessarily limited thereto, but may also be applied to other coil components for various purposes. An example of other coil components for various purposes may include a high frequency inductor, a common mode filter, a general bead, a high frequency (GHz) bead, and the like.

FIG. 1 is a schematic perspective view illustrating a coil component according to an embodiment in the present disclosure so that first and second coil layers of the coil component are seen.

In the following description provided with reference to FIG. 1, a 'length' direction refers to an 'X' direction of FIG. 1, a 'width' direction refers to a 'Y' direction of FIG. 1, and a 'thickness' direction refers to a 'Z' direction of FIG. 1.

Referring to FIG. 1, the coil component according to an embodiment in the present disclosure includes a first coil layer 10, a second coil layer 20 disposed on the first coil layer, a body 40 constituting an exterior of the coil component, and first and second external electrodes 51 and 52 disposed on outer surfaces of the body.

The body 40 may constitute the exterior of the coil component. The body 40 may have an approximately hexahedral shape having opposite end surfaces opposing each other in the length direction, opposite side surfaces opposing each other in the width direction, and upper and lower surfaces opposing each other in the thickness direction, but is not limited thereto.

The body 40 may include a magnetic material. The magnetic material may be metal powder particles including iron (Fe), chromium (Cr), or silicon (Si) as main components or be ferrite powder particles, but is not necessarily limited thereto.

The body 40 may be formed by molding magnetic material-resin composites including a mixture of the magnetic material and a resin in a sheet form and compressing and hardening the magnetic material-resin composites molded in the sheet form on a lower surface of the first coil layer 10 and an upper surface of the second coil layer 20, but is not necessarily limited thereto. Here, a stacked direction of the magnetic sheets may be perpendicular to a mounted surface of the coil component. Here, a term "perpendicular" includes a case in which an angle between two components is approximately 90°, that is, 60° to 120°, as well as a case in which the angle between the two components is 90°.

The body 40 may be formed in core regions of the first and second coil layers, and may fill cavities 11 and 21 penetrating through the first and second coil layers. In the coil component according to the present disclosure, the cavities having a smooth through-structure are formed in the core regions and are filled with the magnetic material, and a flow of a magnetic flux is thus smooth, such that characteristics of the coil component may be excellent.

The first and second external electrodes 51 and 52 serve to electrically connect the coil component to a circuit board, or the like, when the coil component is mounted on the circuit board, or the like, and are connected to lead portions 13' and 23' of first and second coil conductors, respectively, as described below.

Each of the first and second external electrodes 51 and 52 may be formed of a metal having excellent electrical conductivity, for example, silver (Ag), palladium (Pd), aluminum (Al), nickel (Ni), titanium (Ti), gold (Au), copper (Cu), platinum (Pt), tin (Sn), or alloys thereof.

A method of forming the external electrodes and a specific shape of the external electrodes are not particularly limited. For example, the external electrodes may be formed in a C shape by a dipping method.

Figure 2:
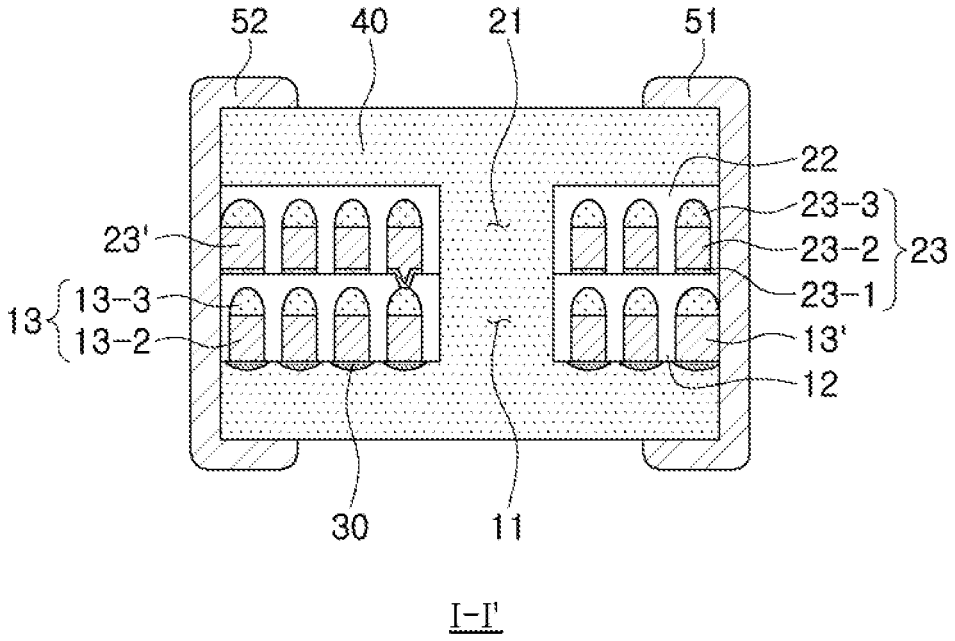
FIG. 2 is a schematic cross-sectional view taken along line I-I' of FIG. 1.

FIG. 2 is a schematic cross-sectional view taken along line I-I' of FIG. 1. Internal structures of the first and second coil layers 10 and 20 of FIG. 1 will be described in more detail with reference to FIG. 2.

The first coil layer 10 includes a first insulating layer 12 and a first coil conductor 13 embedded in the first insulating layer, and the second coil layer 20 includes a second insulating layer 22 and a second coil conductor 23 embedded in the second insulating layer.

The cavities 11 and 21 vertically penetrating through the first and second coil layers are provided in the core regions of the first and second coil layers, respectively. In this case, sidewalls of the cavity 11 formed in the core region of the first coil layer and sidewalls of the cavity 21 formed in the core region of the second coil layer may be connected to each other without having steps therebetween.

A thin film type power inductor is generally manufactured by forming a thin film type coil on a coil substrate by plating, forming a cavity in a central portion of the coil substrate by laser processing, and then filling the surroundings of the thin film type coil including the cavity with a magnetic material. However, in such a thin film type power inductor according to the related art, a large amount of foreign materials may be generated in a process of forming the cavity, and a notch having a V shape is formed in a sidewall of the cavity, such that a crack of a magnetic body frequently occurs.

In contrast, in the present disclosure, the coil substrate does not exist between the first and second coil layers, and as described below, the cavities may be formed by installing or disposing structures in the core regions of the first and second coil layers in a manufacturing process and then removing the structures by chemical etching. Therefore, foreign materials may not be generated in a process of forming the cavities, and notches may not be formed in sidewalls of the cavities, such that a crack of a magnetic body may be effectively prevented.

A material of each of the first and second insulating layers 12 and 22 may be a thermosetting resin such as an epoxy resin, a thermoplastic resin such as a polyimide resin, a resin having a reinforcement material such as a glass fiber or an inorganic filler impregnated in the thermosetting resin and the thermoplastic resin, such as prepreg, Ajinomoto Build-up Film (ABF), FR-4, a Bismaleimide Triazine (BT) resin, a photoimagable dielectric (PID) resin, or the like, but is not necessarily limited thereto.

The first and second coil conductors 13 and 23 are formed in a spiral shape, and are electrically connected to each other by a through-conductor 14 formed in the first insulating layer 12. Lead portions 13' and 23' of the first and second coil conductors exposed externally of the first and second insulating layers are provided at the outermost portions of the first and second coil conductors 13 and 23, respectively, in order to electrically connect the first and second coil conductors 13 and 23 to the first and second external electrodes 51 and 52, respectively, and may be exposed to the opposite end surfaces of the body in the length direction, respectively. The lead portions 13' and 23' of the first and second coil conductors, which constitute portions of the outermost regions of the first and second coil conductors 13 and 23, respectively, may be formed integrally with the first and second coil conductors 13 and 23, respectively.

The first and second coil conductors 13 and 23 may be formed of a material such as a metal having high electrical conductivity, for example, silver (Ag), palladium (Pd), aluminum (Al), nickel (Ni), titanium (Ti), gold (Au), copper (Cu), platinum (Pt), or alloys thereof. In this case, as an example of a preferable process for manufacturing the coil conductors in a thin film shape, an electroplating method may be used. Alternatively, other processes known in the related art may also be used as long as an effect similar to an effect of the electroplating method may be accomplished.

The first coil conductor 13 may be disposed without a separate seed layer. The reason is that a first basic plating layer 13-2 is formed using a metal layer disposed on a substrate as a seed, as described above.

A first anisotropic plating layer 13-3 may be formed on the first basic plating layer 13-2. The first anisotropic plating layer 13-3 may cover the entirety of an upper surface of the first basic plating layer 13-2, but may not cover at least portions of side surfaces of the first basic plating layer 13-2. When the first anisotropic plating layer grown in the thickness direction is formed on the first basic plating layer while being suppressed from being grown in the width direction, generation of a short-circuit between coil patterns may be prevented, and a coil conductor having a high aspect ratio may be implemented. In addition, a direct current (DC) resistance (Rdc) of the coil component may be decreased, and a high inductance of the coil component may be implemented by increasing volumes of the core regions.

The first basic plating layer 13-2 may have a structure in which upper and lower surfaces thereof are flat, and may have a quadrangular cross-sectional shape, but is not necessarily limited thereto. In addition, the first anisotropic plating layer 13-3 may have an upper surface upwardly convex, but is not necessarily limited thereto.

A lower surface of the first coil conductor 13 may be exposed to a lower surface of the first insulating layer 12. In this case, the lower surface of the first coil conductor 13 exposed to the lower surface of the first insulating layer 12 may be coated by a cover insulating layer 30.

The cover insulating layer 30 may be formed by electrodeposition coating. In this case, the cover insulating layer 30 may cover the entirety of the lower surface of the first coil conductor 13, but may not cover at least portions of the lower surface of the first insulating layer 12. In this case, a volume of the body having the magnetic material may be significantly increased to implement a high inductance. However, the cover insulating layer 30 is not necessarily limited thereto.

The second coil conductor 23 includes a seed layer 23-1 covering an upper surface of the first insulating layer, a second basic plating layer 23-2 disposed on the seed layer, and a second anisotropic plating layer 23-3 formed on the second basic plating layer. Meanwhile, a lower surface of the second coil conductor 23 may be in contact with the upper surface of the first insulating layer 12.

The second coil conductor 23 has a configuration similar to that of the first coil conductor 13 except that it further includes the seed layer 23-1 and does not require a separate cover insulating layer since the lower surface of the second coil conductor 23 is in contact with the upper surface of the first insulating layer 12, and a detailed description therefor is thus omitted.

Figure 3:
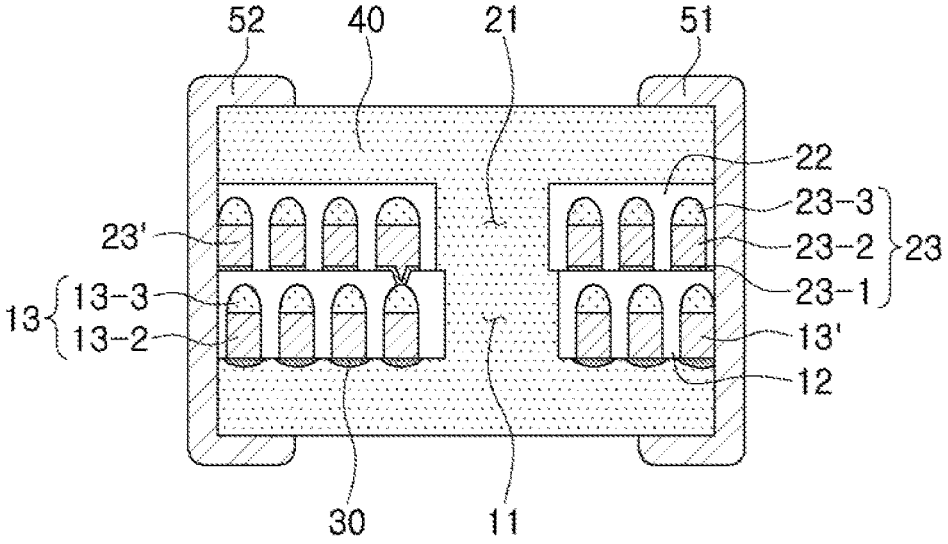
FIG. 3 is a schematic cross-sectional view illustrating a coil component according to an embodiment in the present disclosure.

FIG. 3 is a schematic cross-sectional view illustrating a coil component according to an embodiment in the present disclosure.

Referring to FIG. 3, according to an embodiment in the present disclosure, widths of cavities 11 and 12 formed in core regions of first and second coil layers 10 and 20, respectively, may be the same as each other, and the first and second coil layers 10 and 20 may be disposed so that sidewalls of the cavities 11 and 21 are stepped. In this case, contact areas between a magnetic material constituting a body and the first and second coil layers may be increased, such that close adhesion between the magnetic material and the first and second coil layers may be further improved.

A method of manufacturing the coil component of FIG. 1 will hereinafter be described in detail with reference to FIGS. 4 through 10.

Figure 4:
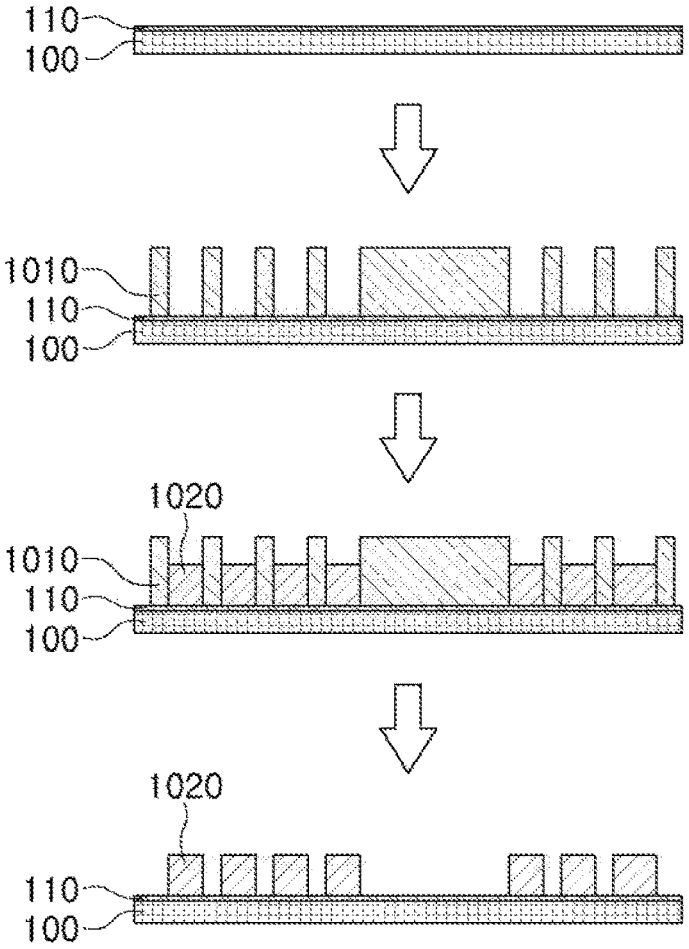
FIGS. 4 through 10 are schematic views illustrating a coil component at various stages of manufacturing using an embodiment of a process of manufacturing the coil component of FIG. 1.

Referring to FIG. 4, a substrate 100 having a metal layer 110 disposed on at least one surface thereof may be prepared. For example, the substrate 100 having the metal layer 110 disposed on at least one surface thereof may be a copper clad laminate (CCL) generally used in a printed circuit board (PCB) field. If necessary, a bonded surface between the substrate 100 and the metal layer 110 may be surface-treated or a release layer may be provided between the substrate 100 and the metal layer 110 to facilitate separation of the substrate 100 in the following process. A material of the substrate 100 may be a resin in which a reinforcement material such as a glass fiber or an inorganic filler is impregnated, for example, prepreg, a thermosetting resin, a photo-curable resin, ABF, or the like, but is not particularly limited thereto. The metal layer 110 may include one or more selected from the group consisting of gold, silver, platinum, copper, nickel, palladium, and alloys thereof, but is not particularly limited thereto.

While, a case in which the metal layer 110 is formed on only one surface of the substrate 100 is illustrated in FIG. 4, the metal layer 110 may be formed on each of opposite surfaces of the substrate 100. In this case, the opposite surfaces of the substrate 100 may be used for manufacturing the coil component, and two coil components may thus be manufactured by one process.

Then, a first mask 1010 having opening patterns may be formed on the metal layer 110 of the substrate 100. The first mask 1010 having the opening patterns may be formed by a photolithography method. For example, an insulating resin may be compressed in a non-hardened film form using a laminator, be hardened, be exposed as desired patterns using a photo-mask, and be then developed to obtain the opening patterns.

Then, a first basic plating layer 1020 may be formed in the opening patterns of the first mask 1010, and the first mask 1010 may be removed. A method of forming the first basic plating layer 1020 is not particularly limited. That is, the first basic plating layer 1020 may be formed by the method well known in the related art, for example, an electroless plating method, an electroplating method, or the like, using the metal layer 110 as a seed and using a resist film such as a dry film, or the like. The first basic plating layer 1020 may be formed of a metal having high conductivity such as, for example, silver (Ag), palladium (Pd), aluminum (Al), nickel (Ni), titanium (Ti), gold (Au), copper (Cu), platinum (Pt), or alloys thereof.

Figure 5:
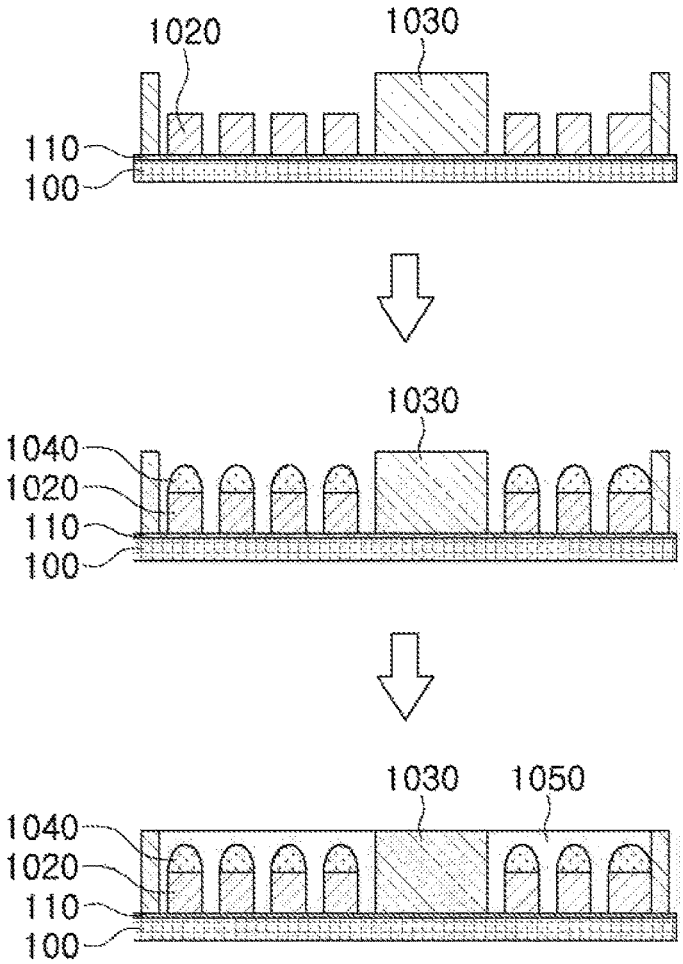

Referring to FIG. 5, a first structure 1030 may be formed in each of a core region and an outer side region of the first basic plating layer 1020. The first structure 1030 may be disposed inside the innermost pattern of the first basic plating layer 1020 and outside the outermost pattern of the first basic plating layer 1020 to prevent anisotropic plating from being performed on the innermost pattern and the outermost pattern in an anisotropic plating process that is to be performed later. In this case, the first structure 1030 formed in the outer side region of the first basic plating layer 1020 may be in contact with a lead portion of the first basic plating layer 1020.

Then, a first anisotropic plating layer 1040 may be formed on the first basic plating layer 1020. In this case, a height of a first coil conductor including the first basic plating layer 1020 and the first anisotropic plating layer 1040 may be smaller than that of the first structure 1030. The first anisotropic plating layer 1030 may or may not be formed of the same material as the first basic plating layer 1020. However, as is the case with the first basic plating layer 1020, the anisotropic plating layer 1030 may be formed of a metal having high conductivity such as, for example, silver (Ag), palladium (Pd), aluminum (Al), nickel (Ni), titanium (Ti), gold (Au), copper (Cu), platinum (Pt), or alloys thereof.

Then, an insulating material may be filled in the region surrounding the first coil conductor to form a first insulating layer 1050 having the same height as that of the first structure. The insulating material may be a thermosetting resin such as an epoxy resin, a thermoplastic resin such as a polyimide resin, a resin having a reinforcement material such as a glass fiber or an inorganic filler impregnated in the thermosetting resin and the thermoplastic resin, such as prepreg, Ajinomoto Build-up Film (ABF), FR-4, a Bismaleimide Triazine (BT) resin, a photoimagable dielectric (PID) resin, or the like, but is not necessarily limited thereto.

Figure 6:
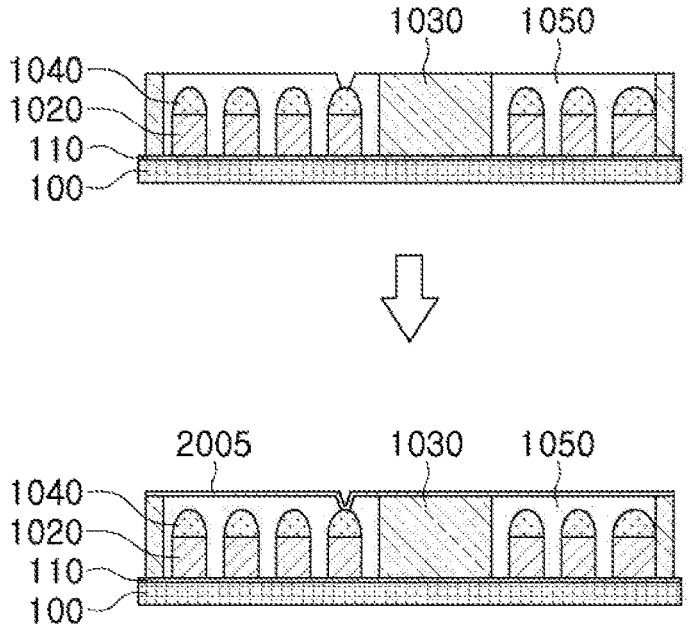

Referring to FIG. 6, portions of the first insulating layer 1050 may be removed to expose an upper surface of the innermost distal end of the first coil conductor, and a seed layer 2005 may be formed on an upper surface of the first insulating layer 1050.

Figure 7:
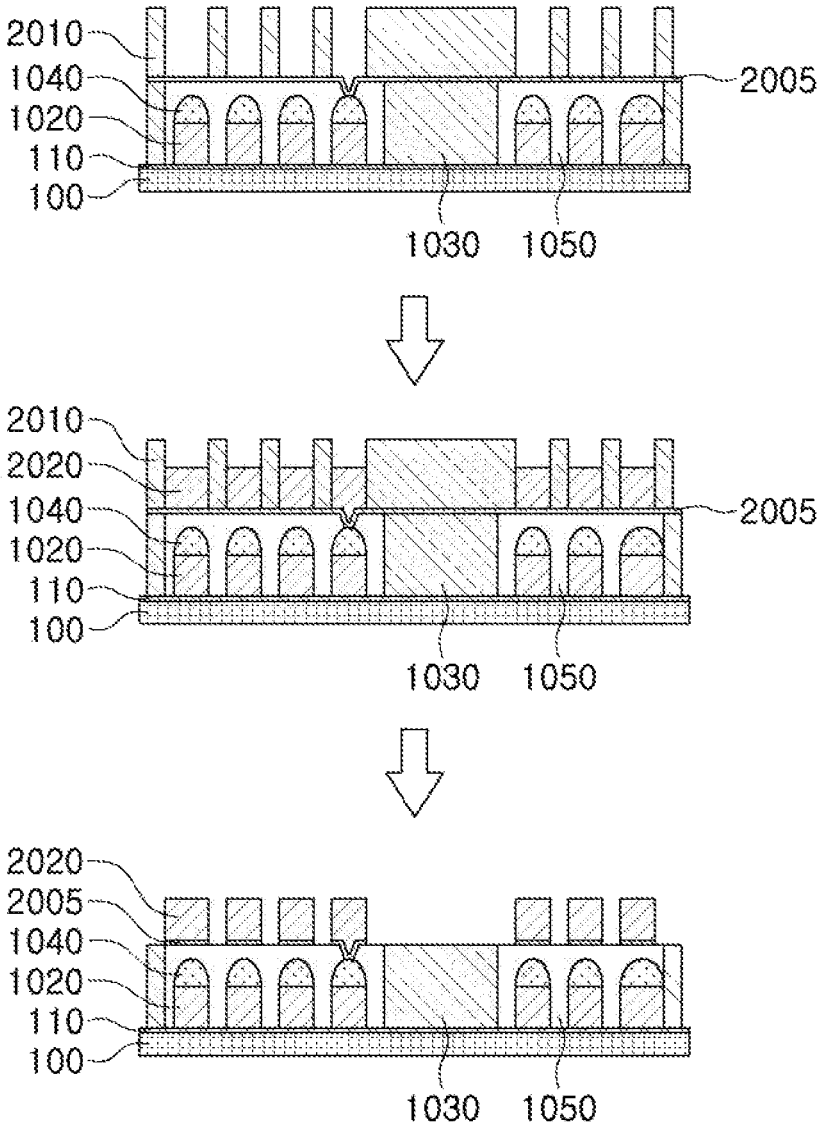

Referring to FIG. 7, a through-conductor and a second basic plating layer 2020 may be formed on the seed layer 2005 using a second mask 2010. The present process is similar to that illustrated in FIG. 3, and a detailed description therefor is thus omitted. The second basic plating layer 2020 may have the same or different material from the first basic plating layer 1020. However, the second basic plating layer 2020 is formed of similar materials with high electrical conductivity as described with respect to the first basic plating layer 1020.

Figure 8:
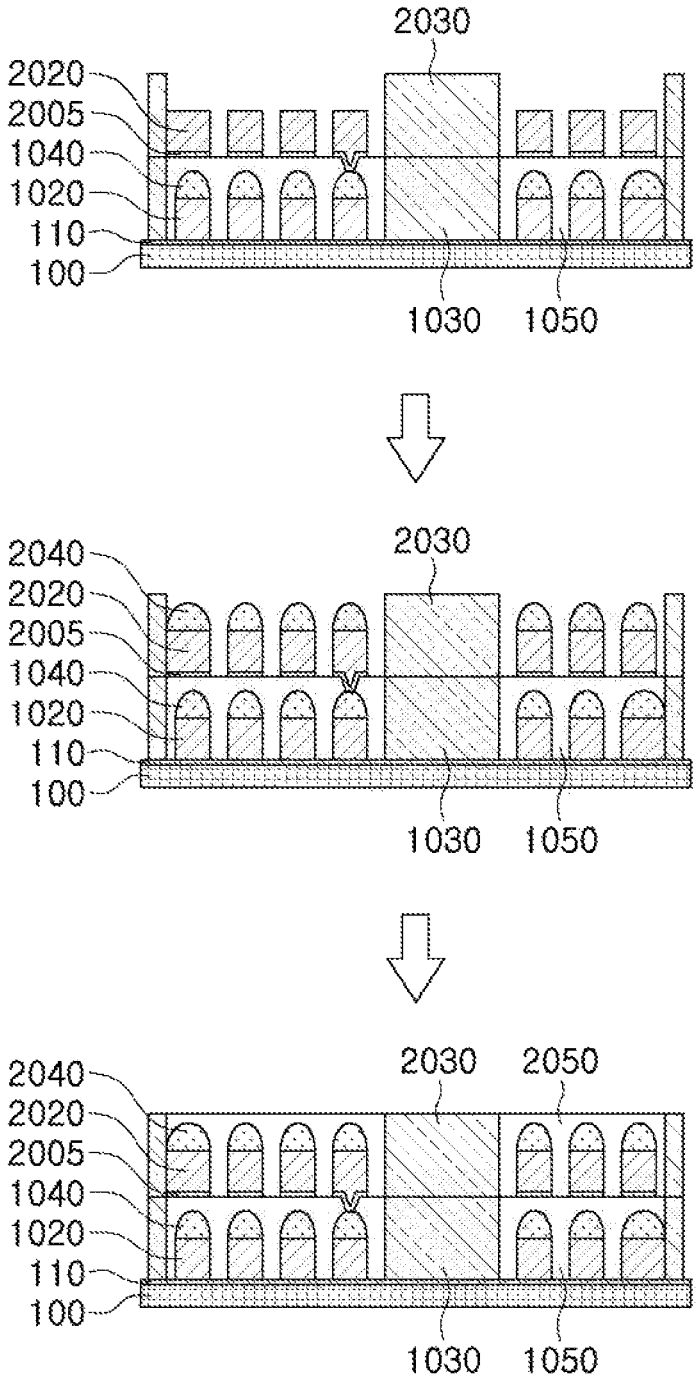

Referring to FIG. 8, a second structure 2030 may be formed on the first structure 1030, and a second anisotropic plating layer 2040 may be formed on the second basic plating layer 2020 to obtain a second coil conductor having a height lower than that of the second structure 2030, and an insulating material may be filled in the region surrounding the second coil conductor to form a second insulating layer 2050 having the same height as that of the second structure. The present process is similar to that illustrated in FIG. 4, and a detailed description therefor is thus omitted. The materials that may be used to form the second anisotropic layer 2040 and the second insulating layer 2050 are the same as those used to form the first anisotropic layer 1040 and the first insulating layer 1050 respectively.

Figure 9:
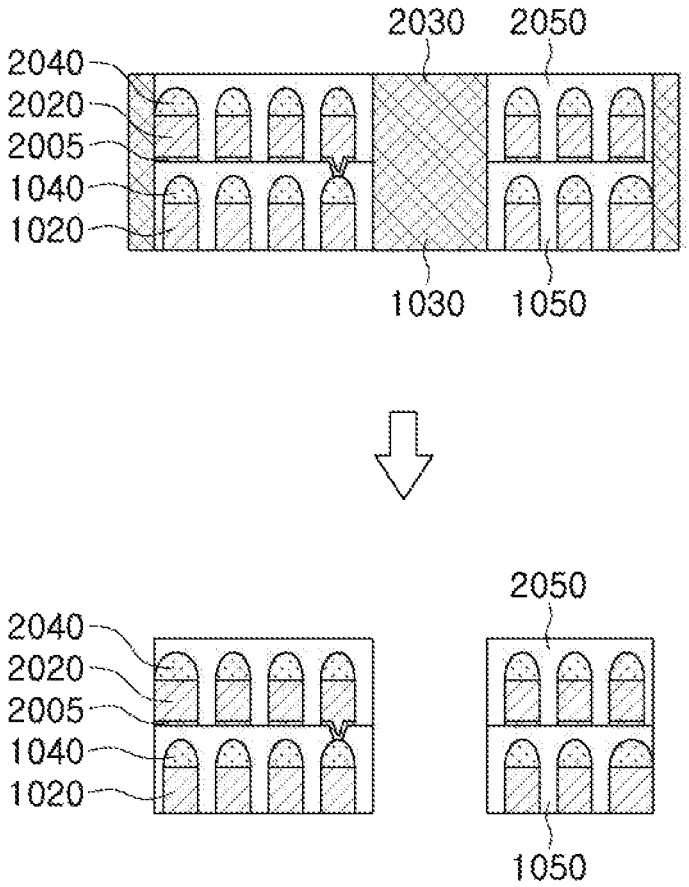

Referring to FIG. 9, the substrate 100 on which the metal layer 110 is disposed may be separated. In this case, the separation may be performed using a blade, but is not limited thereto. That is, any of the methods known in the art may be used for performing the separation.

Then, the first and second structures 1030 and 2030 may be removed by chemical etching. A specific method of the chemical etching is not particularly limited, but may be any of the methods known in the related art. Meanwhile, since cavities are formed by chemical processing rather than physical processing such as laser processing in the present process, foreign materials may not be generated in a process of forming the cavities, and notches may not be formed in sidewalls of the cavities, such that a crack of a magnetic body may be effectively prevented.

Figure 10:
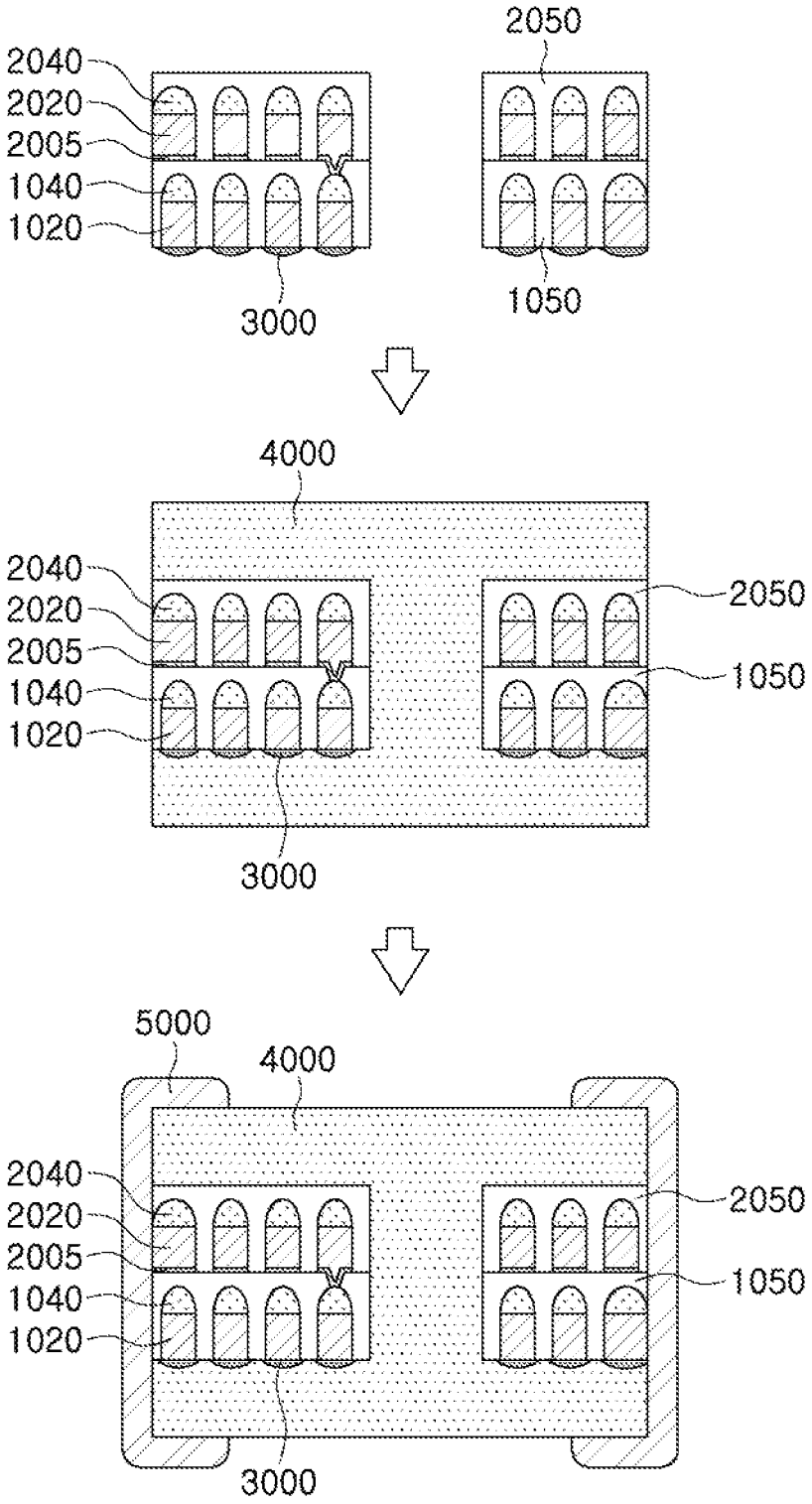

Referring to FIG. 10, a cover insulating layer 3000 covering a lower surface of the first coil conductor may be formed by electrodeposition coating, a body 400 constituting an exterior of the coil component may be formed, and external electrodes 500 may be formed on outer surfaces of the body.

In this case, the body 4000 may be formed by molding magnetic material-resin composites in a sheet form and compressing and hardening the magnetic material-resin composites molded in the sheet form on a lower surface of the first insulating layer 1050 and an upper surface of the second insulating layer 2050, but is not necessarily limited thereto. In addition, the external electrodes 5000 may be formed by the known method such as a printing method, a dipping method, or the like, but are not necessarily limited thereto.

A description for features overlapping those of the coil component according to embodiments in the present disclosure described above except for the abovementioned description is omitted.

As set forth above, according to embodiments in the present disclosure, the crack of the magnetic body may be effectively prevented.

In addition, according to embodiments in the present disclosure, the cavities having a smooth through-structure are formed in the core regions and are filled with the magnetic material, and a flow of a magnetic flux is thus smooth, such that characteristics of the coil component may be excellent.

While embodiments have been shown and described above, it will be apparent to those skilled in the art that modifications and variations could be made without departing from the scope of the present disclosure as defined by the appended claims.

What is claimed is:

1. A coil component comprising:

a first coil layer; and a second coil layer disposed on the first coil layer, wherein the first coil layer includes a first insulating layer and a first coil conductor embedded in the first insulating layer, the second coil layer includes a second insulating layer and a second coil conductor embedded in the second insulating layer, the first and second coil conductors are electrically connected to each other by a through-conductor formed in the first insulating layer, and cavities vertically penetrating through the first and second coil layers are provided in core regions of the first and second coil layers, respectively, wherein the first coil conductor includes a first basic plating layer disposed without a seed layer and a first anisotropic plating layer formed on the first basic plating layer, and the second coil conductor includes a seed layer covering an upper surface of the first insulating layer, a second basic plating layer disposed on the seed layer, and a second anisotropic plating layer formed on the second basic plating layer.

2. The coil component of claim 1, wherein a lower surface of the first coil conductor is exposed to a lower surface of the first insulating layer, and a lower surface of the second coil conductor is in contact with an upper surface of the first insulating layer.

3. The coil component of claim 1, wherein upper surfaces of the first and second coil conductors are upwardly convex.

4. The coil component of claim 1, wherein the first and second anisotropic plating layers entirely cover upper surfaces of the first and second basic plating layers, respectively, and do not cover at least portions of side surfaces of the first and second basic plating layers, respectively.

5. The coil component of claim 2, wherein the first coil layer further includes a cover insulating layer disposed beneath the first insulating layer.

6. The coil component of claim 5, wherein the cover insulating layer entirely covers the first coil conductor exposed to the lower surface of the first insulating layer, and does not cover at least portions of the lower surface of the first insulating layer.

7. The coil component of claim 5, wherein the cover insulating layer is formed by electrodeposition coating.

8. The coil component of claim 1, wherein lead portions of the first and second coil conductors are exposed to side surfaces of the first and second insulating layers, respectively, and the side surfaces of the first and second insulating layers face each other.

9. The coil component of claim 1, wherein sidewalls of the cavities formed in the core regions of the first and second coil layers are connected to each other without having steps therebetween.

10. The coil component of claim 1, wherein widths of the cavities formed in the core regions of the first and second coil layers are the same as each other, and the first and second coil layers are disposed so that sidewalls of the cavities are stepped.

11. The coil component of claim 1, further comprising a body covering a lower surface of the first coil layer and an upper surface of the second coil layer, filling the cavities penetrating through the first and second coil layers, and having a magnetic material.

12. The coil component of claim 11, further comprising first and second external electrodes formed on surfaces of the body and connected to lead portions of the first and second coil conductors, respectively.

* * * * *